United States Patent [19]

Johnson et al.

[11] Patent Number: 4,779,777

[45] Date of Patent: Oct. 25, 1988

[54] SUPPORT BRACKET FOR METAL DETECTOR

[76] Inventors: Frank W. Johnson, 14315 Honeysuckle Way, Nevada City, Calif. 95959; Maurice E. Friedmann, 114 Lawnview Cir., Danville, Calif. 94526

[21] Appl. No.: 727,348

[22] Filed: Jun. 6, 1985

Related U.S. Application Data

[63] Continuation of Ser. No. 528,743, Sep. 2, 1983, abandoned.

[51] Int. Cl.[4] ..... A45F 5/00

[52] U.S. Cl. ..... 224/250; 224/252; 224/269; 224/904

[58] Field of Search ..... 224/252, 269, 270, 250, 224/904, 907, 268, 224, 149

[56] References Cited

U.S. PATENT DOCUMENTS

| | | | |
|---|---|---|---|
| D. 165,253 | 11/1951 | Ward | 224/252 X |
| 984,402 | 2/1911 | Tuttle | 224/270 X |
| 1,326,887 | 12/1919 | Wood | 224/904 X |
| 2,547,620 | 4/1951 | Capano | 224/252 |
| 2,590,732 | 3/1952 | Simancik | 224/270 X |
| 2,651,441 | 9/1953 | Rau et al. | 224/268 X |
| 3,106,350 | 10/1963 | Wiltse et al. | 224/250 X |
| 3,450,317 | 6/1969 | Ramer | 224/904 X |
| 4,431,122 | 2/1984 | Garmong | 224/268 |

*Primary Examiner*—William A. Cuchlinski, Jr.
*Attorney, Agent, or Firm*—Shyamala T. Rajender

[57] ABSTRACT

A support bracket particularly adapted to support the housing portion of a standard portable metal detector includes a clip portion which is adapted to be secured to the belt of the individual using the metal detector, and a channel portion which engages the housing. The bracket includes first and second panel portions joined by a reverse bend to receive a belt therebetween and define a belt support clip. A laterally extending third panel extends outwardly from the lower end of the second panel, and a fourth panel extends upwardly from the distal end of the third to define the channel configuration with the second and third panel members. The channel portion is configured to receive and engage the bottom and sides of the housing portion of a metal detector. A releasable strap extends between the upper edges of the second and fourth panel members to retain the housing in the channel portion.

19 Claims, 1 Drawing Sheet

SUPPORT BRACKET FOR METAL DETECTOR

This is a continuation of application Ser. No. 528,743 filed 9/02/83, now abandoned.

BACKGROUND OF THE INVENTION

There are many individuals who search for buried treasure and other valuables using portable electronic metal detectors. These people pursue treasure hunting usually as a hobby, and occasionally for professional purposes. Some individuals search through old military battle sites for relics, while others concentrate on locations like beaches, where jewelry tends to fall off of bathers' fingers when they enter the water. In any case treasure searching requires hours devoted to scanning the ground with the metal detector search head, watching the readout and/or listening to an audible signal output.

Many metal detectors known in the prior art include a housing which supports the electronics assembly, the battery power supply, and the readout and controls. This housing may be connected to the search head wand by a cable, the housing being supported on the body of the individual using the detector. Unfortunately, the means known in the prior art for supporting the housing are deficient, particularly in that they do not support the housing so that the readout display and controls are visible and accessible to the user. These prior art support devices also do not support the housing in a stable position, especially when the individual must bend down to dig out a suspected find.

SUMMARY OF THE PRESENT INVENTION

The present invention generally comprises a support bracket which is particularly adapted for use with the housing portion of a standard portable metal detector. The bracket includes a clip portion which is adapted to be secured to the belt of the individual using the metal detector, so that the majority of the weight of the device is supported by the body, rather than the hand and arm, of the detector operator.

The bracket includes first and second panel portions joined by a reverse bend to receive a belt therebetween and define a belt support clip. The panel portions are of sufficient size to disperse pressure against the body of the user over an area large enough to prevent discomfort and to prevent twisting of the belt and drooping of the bracket. A laterally extending third panel extends outwardly from the lower end of the second panel, and a fourth panel extends upwardly from the distal edge of the third to define a channel configuration with the second and third panel members. The channel portion is configured to receive and engage the bottom and sides of the housing portion of a metal detector. A releasable strap extends across the opening of the channel portion to resiliently bend the sides inwardly to retain the housing in the channel portion. The channel configuration assures that the housing is disposed with the display panel facing upwardly to be seen by the operator.

DESCRIPTION OF THE PREFERRED EMBODIMENT

The present invention generally comprises a support bracket 10 which is particularly adapted for use with the separate housing portion of a standard portable metal detector. Such a device generally includes a metal wand with a search head at the lower end and a cable extending to a housing in which the electronic components, batteries, readouts, and the controls are supported.

Figure 1:
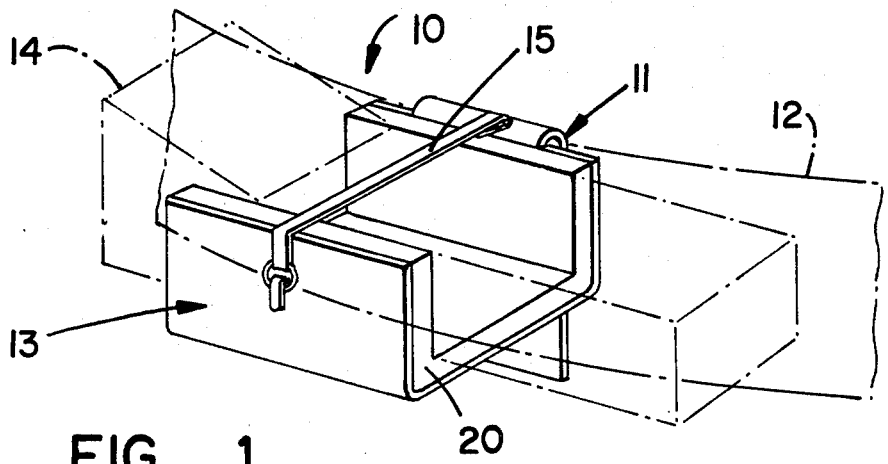
FIG. 1 is a perspective view of the metal detector support bracket of the present invention.
Figure 2:
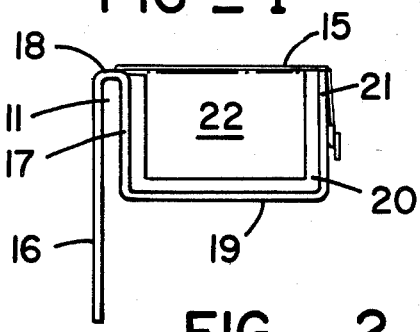
FIG. 2 is an end elevation of one configuration of the support bracket of the present invention.

With reference to FIGS. 1 and 2, one embodiment of the bracket includes a clip portion 11 which is adapted to be secured to the belt 12 of the individual using the metal detector, so that the majority of the weight of the device is supported by the body, rather than the hand and arm, of the detector operator. The bracket also includes a channel portion 13 which is adapted to receive and support the housing portion 14 of the metal detector.

The bracket construction includes parallel panel portions 16 and 17 integrally joined at their upper edges by a reverse bend 18. The confronting portions of the panels 16 and 17 define the belt clip 11 which is adapted to receive a waist or garment belt therethrough. The panel 16 is narrower than the panel 17, and is adapted to be received between the belt and the user's clothing. A laterally extending panel 19 extends outwardly from the lower edge of the panel 17 and is disposed generally orthogonally thereto. Another panel 21 extends upwardly from the distal edge of the panel 19 and generally parallel to the panel 17. The panels 17, 19, and 21 define the channel configuration 13 which has a rectangular cavity 22 therein. The cavity 22 lined with a resilient cushioning material 20, and is configured to the outer dimensions of the bottom and sides of a standard metal detector housing 14 to cradle the housing and provide secure support. A releasable elastic strap 15 extends between the bend 18 and an extrusion protruding from the panel 21 to retain the housing in the channel portion. The laterally extending channel configuration assures that the housing is displayed with the readout panel facing upwardly to be seen by the operator.

Figure 4:
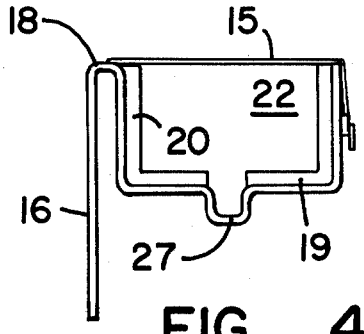
FIG. 4 is an end elevation of a further embodiment of the present invention.

It may be appreciated that there are several "standard" configurations for metal detector housings. Some metal detector housings are provided with one or more protrusions extending from the bottom thereof. With reference to FIG. 4, a further embodiment of the invention includes all of the parts described in the embodiment of FIGS. 1 and 2, except that the lateral panel 19 includes a concave, rectangular channel 27 formed integrally therein. The channel is disposed along the midline of the cavity 22, and provides clearance for such protrusions as are known in the prior art. The channel 27 may be provided with an arcuate or V cross-sectional configuration, and is generally not lined with the cushioning material 20.

Figure 5:
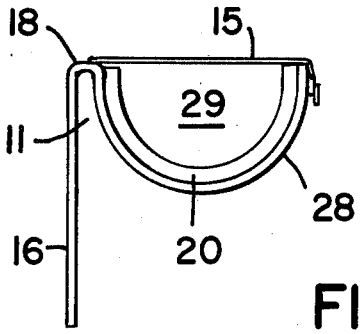
FIG. 5 is an end elevation of another configuration of the support bracket of the present invention.

A further embodiment of the support bracket, depicted in FIG. 5, is adapted for a housing having rounded or arcuate back panels. This embodiment includes the panel 16 and the reverse bend 18, as before. However, an arcuate, semi-cylindrical panel 28 is joined to the reverse bend 18 to define an upwardly opening, concave cavity 29. The distal edge portion of the panel 28 which confronts the panel 16 defines a belt clip 11, as before, to support the bracket.

Figure 3A:
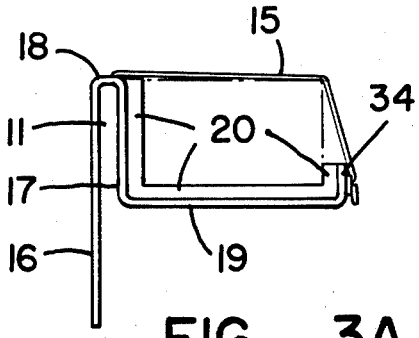
FIG. 3A is an end elevation of a further embodiment of the support bracket of the present invention.
Figure 3:
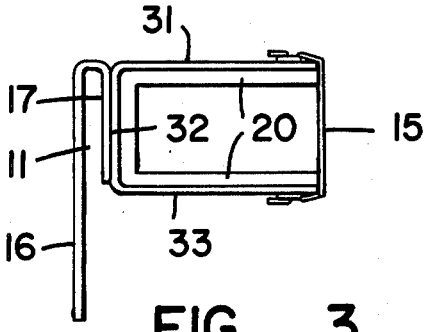
FIG. 3 is an end elevation of another configuration of the support bracket of the present invention.

Another embodiment of the present invention, depicted in FIG. 3, includes the panel members 16 and 17 to define a belt clip 11, as described previously. A trio of panel members 31, 32, and 33 are joined integrally to form a rectangular channel portion which opens laterally outwardly. The elastic strap 15 is joined to extrusions protruding from the distal portions of the panels 31 and 33. It may be appreciated that the panel 31 is sufficiently narrow not to obstruct the user's view of the readout panel of the metal detector.

A further variant of the present invention, shown in FIG. 3A, also includes the panels 16 and 17 defining the belt clip 11. A lateral panel 19 extends from the panel 17, as before, and a narrow lip 34 extends upwardly from the distal edge of the panel 19. The inner surfaces of the panels 17 and 19 and of the lip 34 are lined with the cushioning material 20. The elastic retaining strap 15 extends from the bend 18 to an extrusion protruding from the outer surface of the lip 34, and impinges on an edge portion of the housing. It may be appreciated that the panels 17 and 19 support the side and bottom of the metal detector housing, and that the lip 34 engages the opposed side of the housing to grasp the housing. The strap retains the housing to the bracket is secure fashion. This embodiment may be used in conjunction with metal detector housings having the controls mounted on one side, so that the controls may be accessible from the open side of the bracket.

In all of the embodiments, the panel members may be formed of a form-retaining plastic, metal, or rubber material. The cushioning material 20, which may comprise resilient rubber, foam plastic, or carpeting, cushions the housing, prevents wear between the bracket and the housing, and also prevents the housing from slipping from the channel portion. Also, the tension of the strap 15, in any of the embodiments, causes the channel portion to deflect inwardly and impinge on the sides of the metal detector housing. This effect increases the security of the housing mounting in the channel, and further prevents slippage of the housing in the channel.

We claim:

1. A support bracket constructed to disperse pressure against a user and adapted to support a housing portion of an associated portable metal detector, said support bracket comprising:

a clip portion adapted to slip over a belt of an individual using an associated portable metal detector; and a channel portion adapted to receive and retain a housing portion of an associated portable metal detector;

said clip portion and said channel portion of said support bracket being defined by a plurality of panel sections, said plurality of panel sections including first and second sections joined by a reverse bend in confronting relationship to define said clip portion of said support bracket, said first section of said plurality of panel sections having a length approximately twice the length of said second section of said plurality of panel sections to define a lever arm sufficiently long to disperse pressure against a user over an area large enough to prevent discomfort and prevent twisting of a support belt for said support bracket, at least said second section of said plurality of panel sections being configured to define said channel portion of said support bracket.

2. The support bracket of claim 1, additionally including means for removably securing a housing portion of an associated portable metal detector in said housing portion of said support bracket, said means being secured to said reverse bend of said clip portion of said support bracket and removably fastened to an outer portion of said second section of said plurality of panel sections defining said channel portion.

3. The support bracket of claim 2, wherein said means comprises a strap, and wherein said outer portion of said second section of said plurality of panel sections is provided with means for removably attaching said strap thereto.

4. The support bracket of claim 1, wherein said second section of said plurality of panel sections is configured to include:

a first portion extending substantially parallel to said first section of said plurality of panel sections, a second portion extending substantially perpendicular to said first portion, and a third portion extending substantially perpendicular to said second portion and substantially parallel to said first portion.

5. The support bracket of claim 4, wherein said first and third portions of said second section of said plurality of panel sections have approximately equal lengths.

6. The support bracket of claim 4, wherein said second portions of said second section of said plurality of panel sections includes a section thereof defining a concave channel.

7. The support bracket of claim 1, wherein said second section of said plurality of panel sections includes an arcuate configured section.

8. The support bracket of claim 1, wherein said second section of said plurality of panel sections is configured in a U-shape.

9. The support bracket of claim 1, wherein said plurality of panel sections includes a third section having a U-shaped configuration, said third and second sections of said plurality of panel sections being secured together such that an open end of said U-shaped configured third section extends substantially perpendicular with respect to a first section of said plurality of panel sections.

10. The support bracket of claim 1, additionally including resilient cushioning means positioned in said channel portion of said support bracket.

11. The support bracket of claim 1, wherein at least a portion of said second section of said plurality of panel sections is deformable, and additionally including securing means secured to said reverse bend of said clip portion and removably fastened to said deformable portion of said second section of said plurality of panel sections, such that said deformable portion is pulled toward said clip portion by tension of said securing means.

12. A support bracket constructed to disperse pressure against an associated user and a having clip portion and a housing portion formed from a single continuous strip of material, said clip portion being adapted to be positioned over a supporting member, said housing portion being adapted to receive and retain an associated mechanism therein, said continuous strip of material being formed to include:

a first section joined with a second section by a reverse bend in confronting relationship to define said clip portion of said support bracket, said second section being formed into a generally U-shaped configuration having a pair of spaced and substantially parallel leg portions and an interconnecting body portion, one of said pair of parallel leg portions being adjacent to and confronting said first section, said second section defining said housing portion of said support bracket, said first section having a length significantly greater than a length of said adjacent one of said pair of leg portions of said second section to define a lever arm adapted to disperse pressure against a user over an area large enough to prevent discomfort and prevent twisting of a supporting member for said support bracket; and means for retaining an associated mechanism in said housing portion.

13. The support bracket of claim 12, wherein said retaining means comprises a strap secured at one end thereof to said continuous strip of material at said reverse bend and removably secured to an outer end portion of said second section of said continuous strip of material.

14. The support bracket of claim 12, wherein at least said interconnecting body portion of said second section of said continuous strip of material has an arcuate configuration.

15. The support bracket of claim 12, wherein said interconnecting body portion of said second section of said continuous strip of material includes a concave configured channel therein.

16. The support bracket of claim 12, wherein said pair of leg portions of said second section of said continuous strip of material are approixmately equal in length.

17. The support bracket of claim 12, wherein one of said pair of leg portions of said second section of said continuous strip of material is shorter in length than the other leg portion of said pair.

18. The support bracket of claim 12, additionally including resilient cushioning means disposed in said housing portion thereof.

19. A support bracket for a housing portion of a portable metal detector comprising a clip portion and a channel portion constructed from a continuous strip of material, said clip portion being adapted to slip over a waist belt of an individual using the portable metal detector for supporting said channel portion which is adapted to retain therein a housing portion of the portable metal detector, said clip portion and said channel portion being interconnected by a reverse bend in said continuous strip of material, said channel portion having a generally U-shaped configuration with a pair of leg sections and an interconnecting body section, said leg sections being substantially parallel with respect to a length of said continuous strip material extending from said reverse bend and forming said clip portion, said length of material having a length approximately twice that of a length of an adjacent leg section of said channel portion, to define a lever arm to disperse pressure on an associated user over an area large enough to prevent discomfort of an associated user and to prevent twisting of an associated support belt for said support bracket, means secured to said clip portion and removably secured to said channel portion for retaining a housing portion of the portable metal detector in said channel portion, and resilient cushioning means positioned in said channel portion to prevent wear between said channel portion and the housing portion and to reduce slippage of the housing portion in said channel portion.

* * * * *